US005500049A

United States Patent [19]

Kolinsky

[11] Patent Number: 5,500,049

[45] **Date of Patent: *Mar. 19, 1996**

[54] METHOD FOR APPLYING A SURFACE TREATMENT AGENT ONTO A SURFACE

[76] Inventor: Jay N. Kolinsky, P.O. Box 300, 103 Old Stone Hill Rd., Pound Ridge, N.Y. 10576

[ * ] Notice: The term of this patent shall not extend beyond the expiration date of Pat. No. 5,387,290.

[21] Appl. No.: 319,312

[22] Filed: Oct. 6, 1994

Related U.S. Application Data

[63] Continuation-in-part of Ser. No. 12,880, Feb. 3, 1993, Pat. No. 5,387,290, which is a continuation-in-part of Ser. No. 958,608, Oct. 8, 1992, abandoned, which is a continuation of Ser. No. 766,027, Sep. 26, 1991, abandoned.

[51] Int. Cl.[6] ..... B08B 1/00; A47L 13/16

[52] U.S. Cl. ..... 134/6; 134/32; 134/42; 15/244.1; 15/244.4

[58] Field of Search ..... 134/6, 8, 42, 32, 134/33; 16/97.3, 244.1, 244.2, 244.4; 401/38, 39

[56] References Cited

U.S. PATENT DOCUMENTS

| | | | |
|---|---|---|---|
| 2,789,301 | 4/1957 | Harvey | 15/244.1 |
| 4,190,922 | 3/1980 | Elias | 15/244.2 |
| 4,486,109 | 12/1984 | Rosofsky | 401/39 |
| 4,750,233 | 6/1988 | Swain | 15/244.1 |
| 4,970,750 | 11/1990 | Davis, III | 15/244.1 |
| 5,003,659 | 4/1991 | Paepke | 15/244.1 |

*Primary Examiner*—Jan H. Silbaugh
*Assistant Examiner*—Saeed Chaudhry
*Attorney, Agent, or Firm*—Ostrolenk, Faber, Gerb & Soffen

[57] ABSTRACT

A method of applying a treating agent to a surface, e.g., a vehicle body surface, without undue fatigue. A working pad is formed with a handle attachment part having a first flat surface substantially parallel with a bottom work surface of the pad. A handle is provided with a pad engaging part having a second flat surface. The handle and the working pad are configured to fit with one another by friction, and the first and the second flat surfaces then become aligned flush. The work surface of the pad is placed on the surface after applying a treating agent, and the pad is wiped via the fitted handle over the surface while exerting a downward force.

14 Claims, 3 Drawing Sheets

METHOD FOR APPLYING A SURFACE TREATMENT AGENT ONTO A SURFACE

CROSS-REFERENCE TO RELATED APPLICATIONS

The present application is a continuation-in-part of my co-pending application Ser. No. 08/012,880, filed Feb. 3, 1993, U.S. Pat. No. 5,387,290 and entitled "Hand Polishing Technique for Automobiles and Other Vehicles", which is a continuation-in-part of Ser. No. 07/958,608, filed Oct. 8, 1992, and entitled "Hand Polishing System", now abandoned, which is a continuation of my application Ser. No. 07/766,027, filed Sep. 26, 1991, and now abandoned.

BACKGROUND OF THE INVENTION

1. Field of the Invention

The present invention is directed generally to a method for applying a surface treating agent, preferably a wax, polish or cleaner, to a surface, preferably a smooth surface such as an automobile body surface. While the process of the present invention is particularly useful for applying a treating agent to an automobile body surface, it can be used to apply a treating agent to other surfaces such as glass or wood.

2. Description of the Prior Art

Polishing pad arrangements for use on automobile body surfaces are known in which one or more polishing pads of foam material each have a hollow rubber attachment cup provided on an upper surface. The pads are detachably mountable on a power drive disk that is driven by an electric motor. Such units exist in the form of commercial power orbital polishers and are described below in connection with FIGS. 1 and 2.

Motor driven polishing pad arrangements have a disadvantage in that movement of the pad relative to the automobile body surface is largely defined by the rotary movement of the motor shaft or shafts. This makes it impossible for the user to impart a purely back-and-forth, non-rotational motion to the pad while wiping it over the surface to be polished. In fact, for some applications, it may be harmful to engage a painted body surface with a high speed rotating polishing pad. Surface paint or other finish not intended to be removed may inadvertently be quickly lost due to excessive frictional forces and heating.

Further, the motor and drive gear units of the commercial power polishers are themselves much heavier than the polishing pads attached to them. It therefore becomes difficult for the user to know just how much downward force he or she is exerting as the pads are driven over a body surface under power. Again, this may present a problem for delicate surface finishes.

Safety hazards are also present when using an electrically powered polishing pad unit outdoors if the unit is not properly grounded and/or the user is standing on a wet driveway as is often the case after washing a car prior to polishing it. Also, the powered units can only be used near a source of power such as the AC mains or compressed air.

As far as is known, no cleaning, polishing or waxing technique exists in which a handle contoured to fit comfortably in a user's hand is frictionally engaged with a polishing pad, and the pad is then wiped via the handle over the surface after applying a suitable polishing, cleaning or waxing agent.

U.S. Pat. No. 1,807,137 (May 26, 1931) shows a steel wool pad and holder arrangement for abrasive purposes. In one embodiment, a wooden holder is formed as a handle. A felt pad is attached to the bottom of the holder, and cups of wound steel wool ribbon are mounted on the pad. The patent is concerned with the tendency of steel wool to disintegrate into fine pieces when used for abrasive purposes, and purports to solve the problem by winding the wool in continuous ribbons or strands.

U.S. Pat. No. 5,003,659 (Apr. 2, 1991) discloses a kitchen cleaning and scrubbing tool. The tool includes a sponge having a layer of loop material on a top surface. A handle has a layer of hook material on a bottom surface for gripping the loop material on the sponge. The handle is in the form of a hollow knob for gripping by the thumb and the finger. The patent also discloses an extension handle with a nosed end adapted to fit into a central opening in the knob. U.S. Pat. No. 4,970,750 (Nov. 20, 1990) also shows a household (e.g., bathtub and shower) cleaning device in the form of a sponge block having a rectangular polyhedron shape. The sponge block has a cavity in its top surface, and a rigid support block is inlaid in the cavity and permanently adhered to the sponge block by an elastic adhesive. The support block also has a threaded opening for engaging threads at the end of a long handle.

U.S. Pat. No. 2,829,393 issued Apr. 8, 1958, discloses a cosmetics and lotion applicator for use in applying lotions or creams to the body including one's back. The applicator comprises a pad of porous material which is slipped over a round concave frame from which a long handle extends parallel to the plane of the frame. A cavity defined between the frame and the pad is filled with liquid cosmetic, which is dispensed through the porous pad while the applicator is being used.

U.S. Pat. No. 2,817,106 (Dec. 24, 1957) shows a dish washing and cleaning tool comprised of a disc-shaped sponge pad, and a shell-like rigid handle permanently adhered to the sponge pad by a water-insoluble adhesive. When the handle is gripped and squeezed, a tube containing a liquid detergent inside the handle discharges the detergent onto the sponge pad.

The foregoing patents relate to abrading or cleaning devices having handles and working pads of various forms and materials, for carrying out specific tasks. None of the patents, however, discloses or suggests a handle and pad combination particularly suited for the hand polishing of a painted vehicle body or other surfaces. In particular, none of the known art suggests a technique that enables hand polishing or waxing of a vehicle in such a manner that little, if any, of the muscle cramps or fatigue, commonly associated with present hand polishing or waxing methods, will be experienced.

An object of the invention is to provide a hand rubbing technique for applying a treating agent to a surface such as an automobile body surface, whereby the treatment agent can be applied effectively and without undue fatigue.

Another object of the invention is to provide a hand rubbing technique whereby a friction fit is established between either a base part of a handle and a hollow recess in an application pad, or a handle attachment part of an application pad and a hollow recess in the base part of the handle.

Another object of the invention is to provide an even distribution of working pressure through a larger flat surface as compared with the uneven distribution of pressure exerted by fingertips or palms in the common application methods.

Yet another object of the invention is to provide a hand rubbing technique whereby the base of a pistol-grip handle is adapted to engage an application pad by friction, thereby allowing a user's hand to apply a working force comfortably from the side end of the fist directly and evenly over the surface of the application pad.

Another object of the invention is to provide a vehicle hand rubbing technique that provides results comparable with those obtained with machine powered polishers, but at much less cost.

Yet another object of the invention is to provide a vehicle hand rubbing technique that consumes appreciably less time to complete than other common hand rubbing methods.

A further object of the invention is to provide a hand rubbing technique for applying a treating agent to a surface such as the exterior of an automobile whereby a friction fit is established between a handle and an application pad, and the pad will separate from the handle during use thereby alerting the user that additional treating agent (or a liquid) must be applied to the surface or pad.

Another object of the invention is to provide a rubbing technique whereby a comfortable handle and an application pad are fitted to one another by friction thereby protecting the pad from being torn during use, since the pad is not permanently attached to the handle by any adhesive or other means.

Yet another object of the invention is to maintain a proper balance between downward and lateral forces applied to an application pad handle during use, whereby the pad will separate from the handle if such a balance is not maintained.

The method of the present invention preferably utilizes an applicator comprising an application pad and a handled attachment part with a first flat surface substantially parallel to a bottom work surface of the pad. The handle is provided with a hand grip part and a pad engaging part fixed with respect to the hand grip part and having a second flat surface. The handle and the application pad are fitted to one another by friction so as to facilitate easy separation later. One of the pad engaging and handle attachment parts is urged into a recess in the other one of said parts to engage the other part by friction, and the first flat surface of the handle attachment part is aligned flush with the second flat surface of the pad engaging part.

The method also includes grasping the hand grip part of the handle and exerting a downward force which is transmitted through the flush first and second flat surfaces evenly across the bottom work surface of the pad. The pad while fitted to the handle is then wiped over the vehicle body surface while a downward force is exerted.

In accordance with the method of the present invention, a treating agent is applied to a surface utilizing an applicator comprising a pad and a handle that are releasably coupled together and are separable from one another when the friction force between a working surface of the pad and the surface being treated becomes great enough to overcome forces holding the pad to the handle. The method comprises the steps of:

(a) selecting a surface to be treated;

(b) applying a treating agent to at least one of the working surface of the pad or a portion of the surface to be treated;

(c) spreading the treating agent over the surface while exerting a downward force on the handle thereby producing a friction force between the pad and the surface; and (d) stopping the application of the agent to the surface to be treated when the pad is separated from the handle upon the friction forces between the working surface of the pad and the surface being treated overcoming the friction fit forces holding the pad to the handle.

While the preferred use of the method of the present invention is on automobile surfaces, the disclosed process can be used on other surfaces such as glass and wood furniture surfaces.

For a better understanding of the present invention, together with other and further objects, reference is made to the following description taken in conjunction with the accompanying drawing, and the scope of the invention will be pointed out in the appended claims.

DETAILED DESCRIPTION OF THE INVENTION

Figure 1:
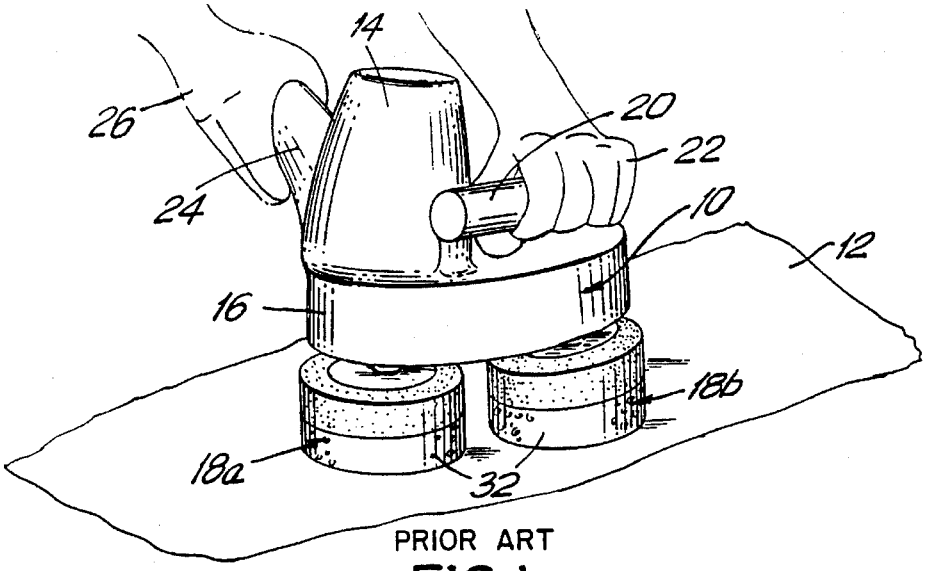
PRIOR ART FIG. 1
FIG. 1 is a view of a conventional power orbital polishing machine in use.

FIG. 1 shows a conventional power orbital polisher 10 as used to polish a surface 12 on, e.g., an automobile. The polisher 10 has an electric motor housing 14, and a casing 16 that contains motor drive components including such gearing (not shown) as is necessary to drive a pair of polishing pads 18*a*, 18*b* for rotational and orbital movement relative to the surface 12.

The polisher 10 also has a bar handle 20 fixed across a forward portion of the top of casing 16 to enable the polisher to be gripped with a user's left hand 22. Another handle 24 protrudes rearwardly of the casing 16 to be grasped by the user's right hand 26. When energized via an AC line cord (not shown), the polisher 10 drives the polishing pads 18*a*, 18*b* for rotational movement against the surface 12 as the user guides the polisher 10 over an area of the surface 12 to be polished.

Figure 2:
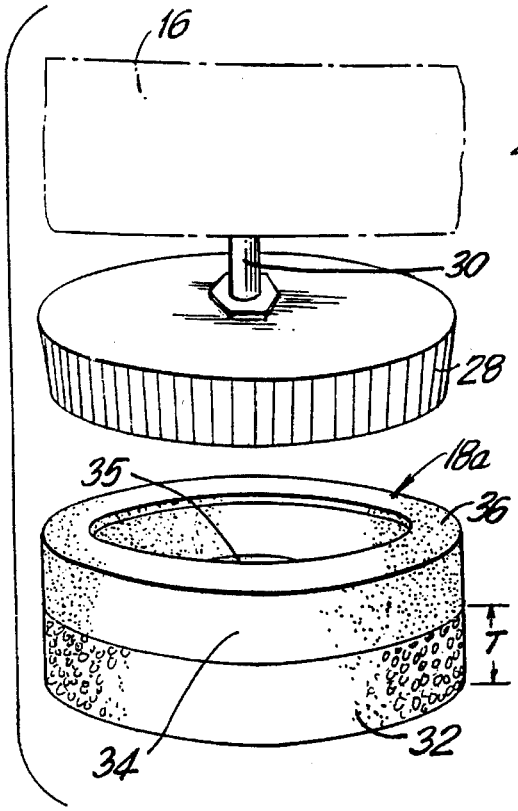
PRIOR ART FIG. 2
FIG. 2 is an enlarged view showing a polishing pad and a power drive wheel of the machine in FIG. 1.

FIG. 2 shows one of the polishing pads 18*a* as detached from a power drive wheel or disk 28. The disk 28 is fixed to a shaft 30 which, in turn, is connected to an eccentric rotary member (not shown) that is driven by the motor housed in the polisher 10.

Each polishing pad is comprised of a foam working part 32 in the form of a cylindrical pad having a certain thickness T. The working part 32 of the polishing pads 18*a*, 18*b* may be made of any foam material currently used in cleaning, polishing or waxing applications, for example, urethane, polyester, polyether or polyethylene foam materials.

The pads 18*a*, 18*b* also have an attachment part 34 extending upwardly from the top surface of the working part 32. The attachment part 34 is in the form of a hollow rubber cup having a thin rubber lip 36 extending radially inwardly from the upper circumference of the attachment part 34. The attachment part 34 is fixed to the working part 32 of the pad 18*a* by way of an adhesive applied between an elastic bottom surface 35 of the attachment part 34, and the upper surface of the working part 32. The overall diameter of the pad 18*a* is typically about four inches.

Pad 18*a* is secured to the power drive disk 28 of the polisher 10 by way of a tight friction fit between the elastic attachment part 34 of the pad including the thin rubber lip 36, and the disk 28 when the latter is inserted in the hollow of the attachment part 34 with the wall of the attachment part and the lip 36 stretched tightly over the outer periphery of the disk 28 (see FIG. 1). Such a tight or friction fit between the pads 18*a*, 18*b* and the corresponding power drive disks 28 of polisher 10 has proven adequate to allow the working parts 32 of the pads to engage surfaces to be cleaned or polished while undergoing both rotational and lineal or orbital movement relative to the surface.

Figure 3:
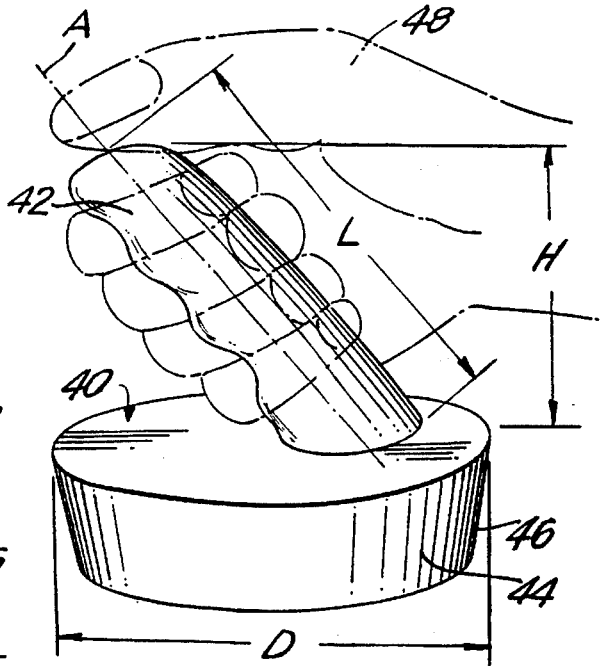
FIG. 3 is a perspective view of a polishing handle according to the invention.
Figure 9:
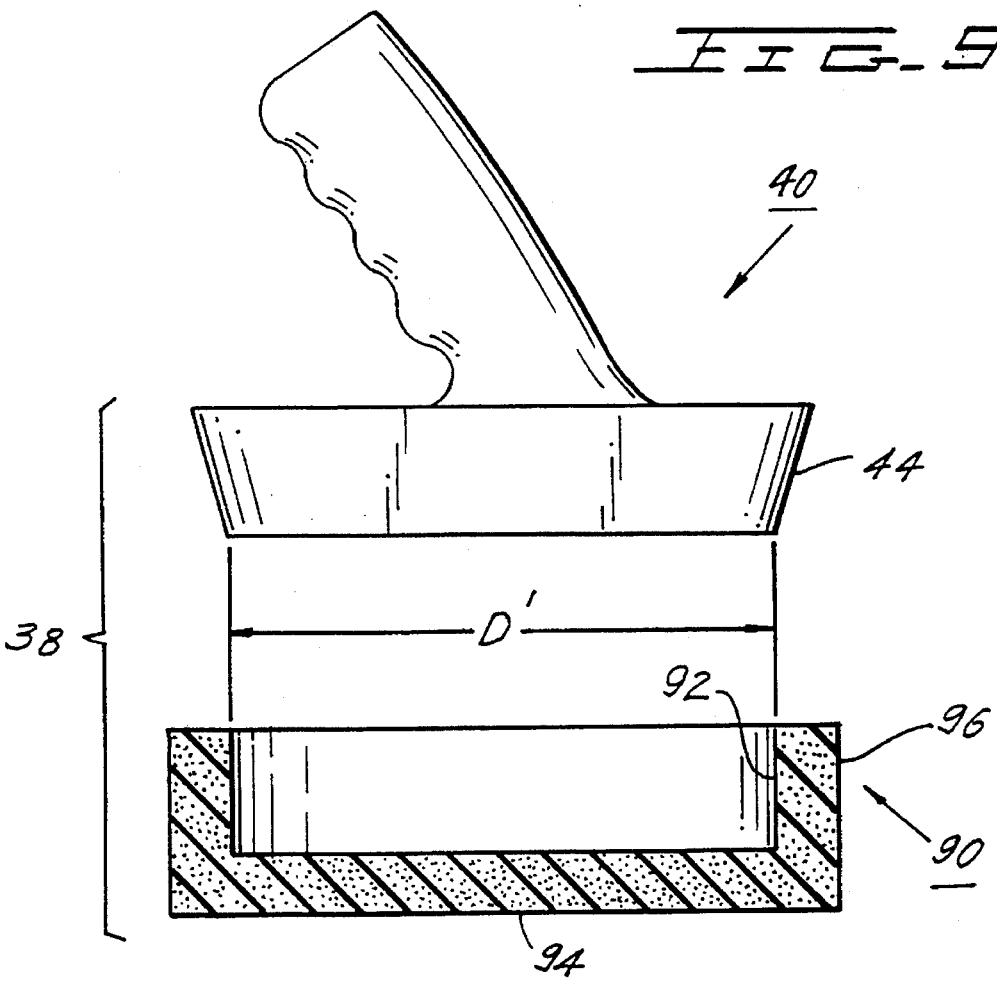
FIG. 9 is an exploded view, partially in section, showing the handle of FIG. 3 fitted with another polishing pad according to the invention.
Figure 10:
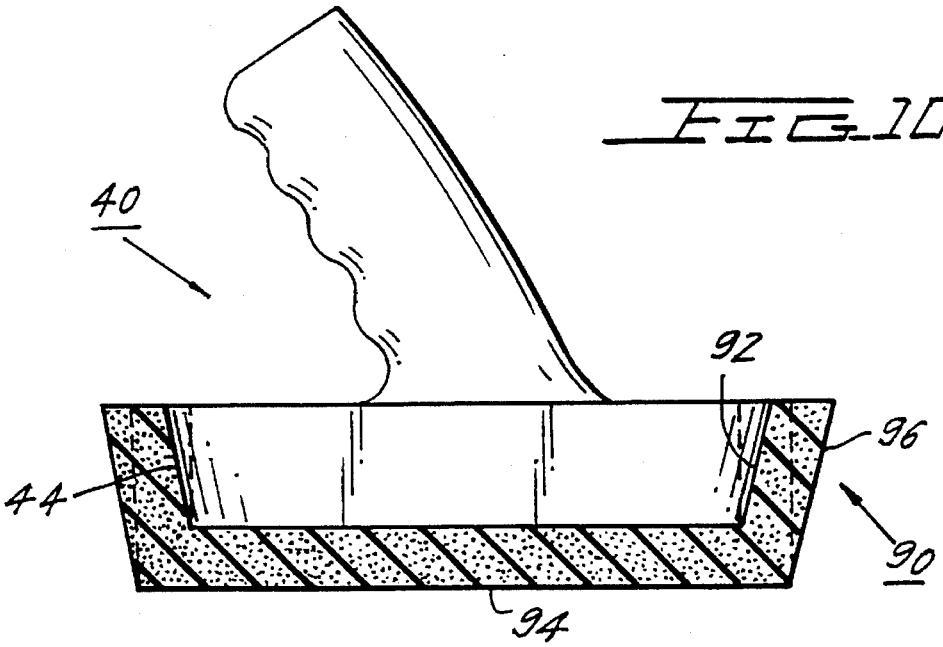
FIG. 10 is a side view, partly in section, showing the cooperation between the handle and pad of FIG. 9.

Referring to FIGS. 3, 9 and 10, a first embodiment of an applicator 38 for use with the method of the present invention is shown. The applicator 38 includes a handle 40 and an application pad 90. The handle 40 has a hand grip part 42 in the form of a "pistol" grip, and a pad engaging part 44. The pad engaging part 44 is adapted to be received in a corresponding recess 92 in the application pad 90. The application pad 90 is preferably formed of a resilient foam material such as a polyether foam. The bottom of the pad 90 forms an application surface 94 which is used to spread the surface treatment over the surface to be treated.

As best shown in FIG. 9, the pad engagement part 44 forms part of a truncated cone. Preferably, the walls 96 of pad 90 extend perpendicular to the application surface 94 thereby forming a generally cylindrical recess 95 into which the pad engagement part 44 is inserted. As the part 44 is inserted into the recess 95, the side wall 96 expands outwardly. The inward resilient nature of walls will cause the side wall 96 to flex inwardly against the pad engaging surface of part 44 so as to increase the friction fit between the pad 90 and handle 40.

While many variations can be used, the relative size, shape and materials of the pad 90 and pad engaging part 44 are selected to cause the pad to remain on the handle 40 during application of the treating agent to the surface being treated until the treating agent becomes sufficiently dry that more treating agent is required. At that point, it is preferable that the friction forces between the pad 90 and the surface being treated overcome the friction forces between the pad 90 and the pad engaging part 44 so that the pad will be partially or wholly separated from the handle 40.

If it is desirable to increase the friction force at which the pad 90 separates from the handle 40, the bottom surface of the pad engaging part 44 can be roughened, for example, by forming cylindrical or cross-hatched grooves in the part 44 or by roughening the part 44 with sandpaper. Alternatively, sandpaper can be glued to the bottom surface of part 44.

In the preferred embodiment, the pad 90 is formed of a single piece. If desired, it can be formed by two or more separate pieces formed out of the same or different materials. This might be desirable, for example, if the required characteristics (e.g., resiliency and strength) of the walls 96 should be different than the characteristics of the portion of the pad 90 located below the recess 92.

In the preferred embodiment, the diameter (D) of the pad engagement portion 44 is approximately 3.75 inches while the overall height H of the hand-grip part 42 from the upper surface of the engaging part 44 measures typically about 4 inches and the length L of grip part 42 is about 5 inches long to accommodate the closed hand or fist 48 of a user.

Figure 7:
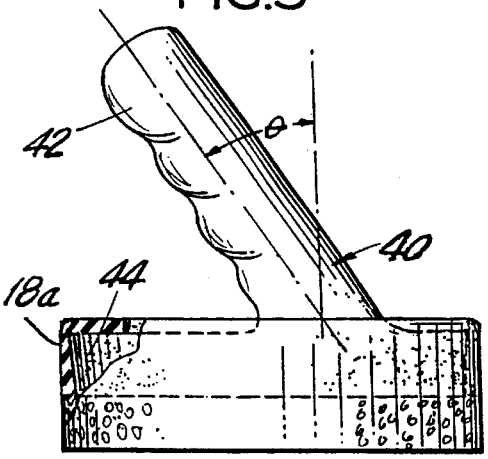
FIG. 7 is a side view, partly in section, of the handle of FIG. 3 fitted in the polishing pad of Fig. 2.

Importantly, the axis A of hand grip-part 42 is offset angularly from the normal direction relative to the surface to be cleaned or polished when a pad 18*a* is fitted over the engaging part 44, as depicted in FIG. 7. It has been discovered that the user can exert relatively large downward forces on the handle 40 and thus onto the pad 18*a* while engaging a work surface, and maintain such forces while moving the handle and pad combination over the surface for long periods of time with relatively little user discomfort or fatigue as compared to the common method of using a polishing cloth or pad alone by hand. When cleaning surfaces approximately at the height of the user's elbow such as the front hood or rear trunk of an automobile, it has been found that an offset angle 0 of about 40 degrees between the axis A and the normal direction N (See FIG. 7) affords the user great working efficiency with minimal fatigue during the course of an entire automobile cleaning, polishing or waxing operation. If the handle and pad combination of the present invention is often used for cleaning surfaces much higher or lower than the user's elbow level, the offset angle of axis A of the grip part 42 can be modified to approach the direction of the normal N (FIG. 7) for surfaces higher than the user's elbow level, or to depart further from the normal direction for lower surfaces.

Although the material of the pad 90 has been described as made of foam, other materials may be employed for purposes of cleaning, scouring, sanding, or any other working or finishing operation to be applied to a surface which operation requires a hand rubbing force.

The handle 40 can be made of any rigid, non-harmful durable material including but not limited to wood, various metals, fiberglass, or any of the common plastics materials capable of being cast or molded into a described form at relatively low cost.

Figure 4:
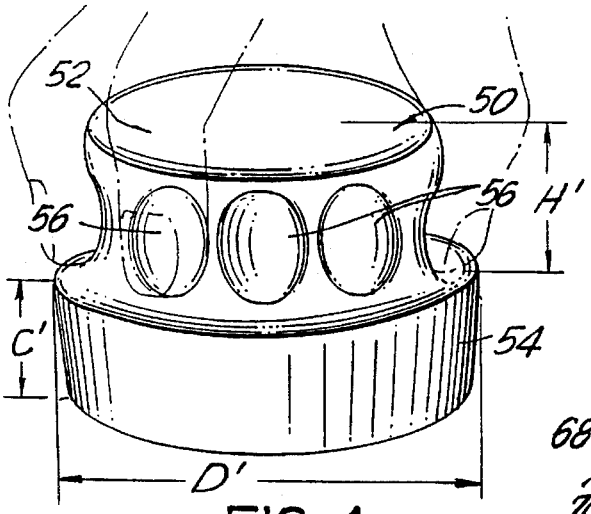
FIG. 4 is a perspective view of a second embodiment of a polishing handle according to the invention.

FIG. 4 is a view of a second embodiment of a handle 50 which can be used in carrying out the process of the present invention.

The handle 50 can be made of any of the materials mentioned in connection with the handle 40 of FIG. 3, and includes a hand-grip part 52 and pad engaging part 54. The pad engaging part 54 corresponds in shape and dimensions to the pad engaging part 44 of the handle 40, i.e., part 54 conforms in shape to the recess 92 in the pad 90 of FIG. 9. Handle 50 differs from handle however, in the form of the grip part 52 which, as shown, conforms to a user's hand and fingers with the palm facing downwardly. A series of dimples 56 or finger indents are formed in a circumferential wall of the grip part 52 to allow the use's fingers and thumb to grasp the part 52 of the handle 50 most comfortably while obtaining a tight grip.

As with the handle 40 of FIG. 3, handle 50 preferably has a maximum diameter D' of about 3¾ inches, with a depth C' of part 54 measuring about 0.75 inches. The overall height H' of the grip part 52 is preferably about 1.75 inches.

Figure 5:
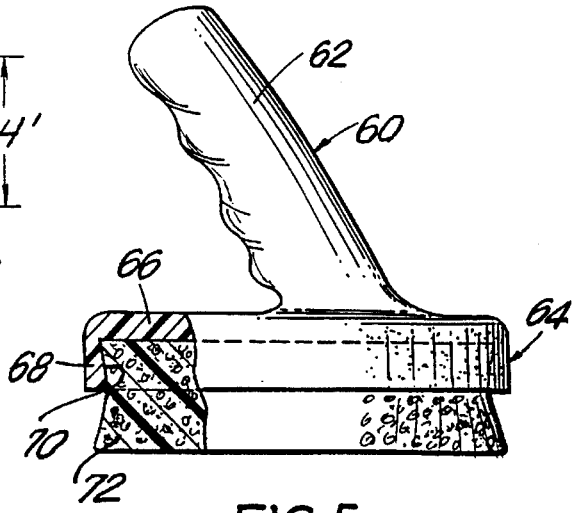
FIG. 5 is a side view, partly in section, of a polishing handle and pad arrangement according to a third embodiment of the invention.

FIG. 5 is a view of a third embodiment of a handle and pad arrangement which can be used in carrying out the method of the invention. A handle 60 is formed with a hand grip part 62 similar in shape and form to the grip part 42 of the handle 40 in FIG. 3. Handle 60 also has a pad engaging part 64 comprised of a flat circular base 66 to which the grip part 62 is joined, and an annular lip 68 extending downwardly from the outer circumference of the base 66 as shown in FIG. 5. The annular lip 68 has an inner periphery 70 that tapers radially inwardly in the direction away from the grip part 62, and a cleaning, polishing or waxing pad 72 of foam or other resilient material is captured by the handle lip 68 after the material of the pad 72 is compressed in its upper region to be fitted inside the lip 68, flush against the bottom of the handle base 66.

Figure 6:
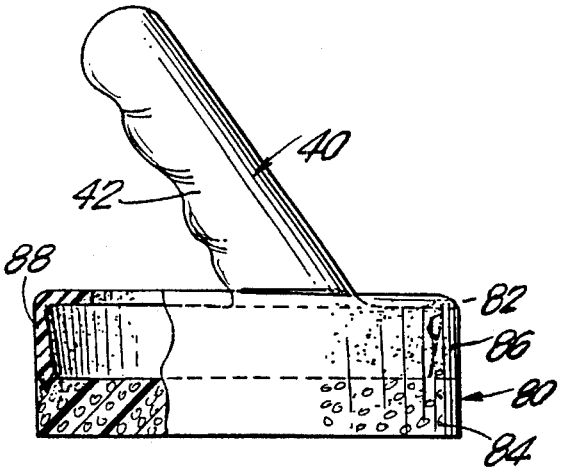
FIG. 6 is a side view, partly in section, showing the handle of FIG. 3 fitted in a polishing pad made according to the invention.

FIG. 6 is a view showing the handle 40 of FIG. 3 fitted within a pad 80 having a working part 84 made of foam or other suitable cleaning, polishing or waxing material. Pad 80 has an engaging or attachment part 86 for gripping the base part of the handle 40. An annular elastic ring 88 corresponding to the attachment part 34 of the pad 18*a* in FIG. 7, extends from the upper circumference of the working part 84, and defines an upper recess 82 for receiving the handle base. Ring 88 may be molded together with the material of the working part 84 of the pad 80, glued or otherwise adhered to the working part 84 with sufficient strength to withstand normal working forces applied through the handle 40 to the pad 80.

Figure 8:
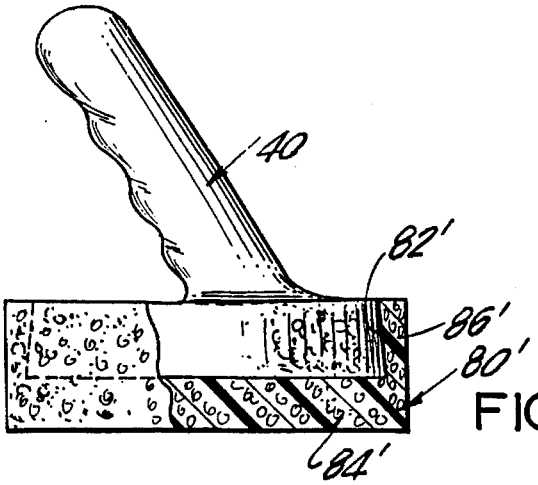
FIG. 8 is a side view, partly in section, of the handle in FIG. 3 fitted in a polishing pad made entirely of foam material.

FIG. 8 is a view showing the handle 40 of FIG. 3 fitted within a pad 80' made entirely of foam or other suitable material. Pad 80' differs from the pad 90 in FIG. 9 in that the pad 80' is formed with an upper recess 82' such that a working part 84' and an engaging or attachment part 86' of the pad are formed integrally of the same material. The strength of the pad material forming the engaging part 86' may be greater than that of the material residing in the working part 84' to enable the pad 80' to stand up to various forces transmitted via the handle 40 when fitted tightly in the upper recess 82' of the engaging part 86'.

In each of the foregoing embodiments, the size, shape, surface structures and materials of the handle and pad are selected to cause the pad to allow the pad to have the ability to at least partially separate from the handle when friction fit forces holding the pad to the handle are overcome by the friction forces between the pad and the surface being treated. Since the point at which the pad will separate from the handle is a function of many parameters including the downward and lateral forces exerted by the person applying the treating agent, there is no one friction force between the surface being treated and the pad at which the pad will separate from the handle. Nonetheless, the size, shape, surface structure and materials can be selected to achieve the desired result under many circumstances.

When using the present invention to clean a smooth surface such as the exterior body surface of an automobile or other vehicle, a suitable conventional cleaning, polishing or waxing agent may be placed either on the work surface of the polishing pad, or directly on the vehicle body surface. The agent may be in paste or liquid form, and may include an abrasive material ranging from very coarse to extremely fine grade depending on the kind of finish desired.

One of the handles is then fitted to a corresponding working pad either by (1) urging the pad engaging part of the handle into the recess in the handle attachment part of the pad thereby engaging the pad by friction, or by (2) urging the handle attachment part of the pad into the recess in the pad engaging part of the handle thereby engaging the handle by friction. In either case, it will be appreciated that later separation of the handle and the working pad is facilitated when a used pad is to be removed and replaced with a new one or like construction. Because the pad is not permanently attached to the handle by an adhesive or other means, it will also separate from the handle during use if excessive lateral or frictional forces are encountered. This "pop off" kind of action is highly desirable because it (1) saves the pad from becoming torn by excessive working stresses, and (2) alerts the user that the liquid or paste treatment agent (e.g., a wax, polish or cleaner having a liquid component) being applied to the surface to be treated is becoming dry and that more treatment agent (or, alternatively, a lubricating liquid such as water or oil) needs to be applied.

With the first flat surface of the handle attachment part of the pad aligned flush with the second flat surface of the pad engaging part of the handle, the user grasps the handle and exerts a downward force which is transmitted through the flush surfaces evenly across the work surface of the pad. The pad therefore always maintains uniform contact with the surface to be treated during use.

Once fitted to the handle, the working pad is then wiped by hand over the surface while exerting the downward force on the handle.

As mentioned, an important feature of the present technique is to provide a pad friction or stress limit warning feature. For example, when polishing a vehicle with either a liquid or paste type abrasive polish, it is important to keep the polish "wet". Once the cleaning, polishing or waxing agent dries, additional rubbing will only remove the agent from the surface being worked and further polishing action will not take place. Polishing agents usually contain water or oil to make them wet. When the agents are rubbed onto the surface of a vehicle, friction is created by lateral movement between the work surface of the applicator cloth or pad, and the vehicle body surface on which the polishing agent is applied. As the polishing agent dries, the friction increases and lateral movement of the cloth or pad over the vehicle surface requires greater and greater hand-applied force to overcome. The necessary force increases up to the time of complete drying of the polishing agent, at which time no further polishing action occurs and the dry polish is simply removed by further hand rubbing.

According to the present technique, at or near the time when the treatment agent becomes completely dry, the side-ways or lateral forces exerted by the handle on the fitted pad will enable the handle base to unseat itself from the recess in the pad, or the pad will become unseated from the recess in the handle base (depending on which embodiment of the present handle and pad combinations is being used). This "pop off" feature alerts the user to apply more treating agent or simply to apply a little water to the surface being treated. Once added, the lateral frictional forces will be reduced and treatment can be continued after the pad is replaced on the handle and wiped over the smooth surface.

It will be appreciated that the point at which the pad will unseat itself from the handle during use because of excessive friction as the treatment agent dries, is a function of (a) the pad's density and configuration, (b) the kind of treating agent (e.g., polish) being used, and (c) the degree of both downward and lateral forces being exerted on the handle at a given time. Different kinds of foam materials for the pad will require a different minimum downward force to be applied via the handle while working a treatment agent of proper consistency on the surface being treated. A user will quickly learn the proper balance between downward and lateral hand forces when using a treatment agent of the proper consistency. If the correct balance is not maintained, the handle and pad will become separated during use.

Also, as mentioned, because the pad is not permanently adhered to the handle, the pad will be protected from tearing by excessive lateral forces, by becoming separated from the handle during use.

When polishing a vehicle after the polishing agent is worked over the vehicle surface by the pad and becomes dry, all residue is preferably removed either by washing the vehicle with water and allowing it to dry, or by buffing with a dry cloth.

EXAMPLE ONE

A handle and pad combination as shown in FIG. 8 was used to clean and polish a 1985 Chrysler, Fifth Avenue model, having Black Crystal coat paint (Chrysler code PX8). Ambient temperature was 75° F. A liquid water based polish obtained from Malm Chemical Corp., Pound Ridge, N.Y., was also used (Malm's Ultra-Fine Polishing Cleaner, Stock No. 5556-P).

The entire handle 40 was made of injected molded plastics consisting of a 50 percent mixture of polycarbonate and 50 percent ABS. The grip art 42 of the handle was textured with "Mold-Tech" #MT-1013, and the pad attachment part 44 of the handle was textured with "Mold-Tech" #MT-1145. The bottom surface of the attachment part was 3.275 inches diameter. The attachment part was 0.775 inches high, and the diameter of the top surface of the attachment part was 3.325 inches diameter.

The foam pad was formed of yellow, open cell polyether foam having an overall diameter of 4.0 inches and an overall height of 1.2 inches. The diameter of the recess in the pad was 3.075 inches, and the depth of the recess was 0.850 inches. The pad material was made by General Foam Corp. in Pennsylvania, polyether foam grade 13000XXX, and having a cell count of 36 per inch.

The vehicle surface was first washed with a mixture of one ounce Malm Chemical Corp. liquid car wash diluted with two gallons water. The vehicle was then dried.

One tablespoon of polish was placed on the vehicle hood, and the foam pad then placed in contact with the polish. The pad engaging part of the handle was then urged into the pad recess using about two pounds force.

The handle/pad combination was then moved in a circular motion defining approximately 12-inch diameter circles over the flat surface of the vehicle hood, covering no more than 4 square feet. About ten pounds downward force was applied on the handle. After about two minutes, the liquid polish began to dry and lateral friction resistance increased considerably to the time when the polish became totally dry. Any further attempts at lateral movement caused the pad attachment part of the handle to become unseated from the recess in the polishing pad.

A tablespoon of water was then added to the now-dry surface, in order to wet the dry polish residue. The water softened the polish to the point where easy lateral movement of the pad again became possible, and further polishing action took place.

As mentioned, it is important to understand that a significant benefit of the present technique is to enable liquid or paste polishes or waxes to be worked on a vehicle body surface with minimal user fatigue. When the polishing or waxing process is completed, the dry polish residue or excess wax should be removed either by washing the vehicle or buffing the vehicle surface with a dry cloth.

It will be appreciated that when carrying out the present hand polishing technique using any of the embodiments of FIGS. 3–8, the exterior body surface of a vehicle can be cleaned or polished very effectively, with significantly reduced hand, finger or wrist fatigue as is common in conventional hand polishing methods.

In the foregoing description, the treating agent has been described as a liquid or paste which is separate from the pad. It should be recognized, however, that the treating agent can be impregnated in the pad. Indeed, the pad itself can be the treating agent. For example, the pad may have a sandpaper surface if the treatment to be applied to the treated surface is a sanding treatment or a scouring surface if the treatment to be applied to the treated surface is a scouring treatment.

If desired, the pad may be formed of a working portion and then attaching portion. The working portion will preferably be made of a foam-like material. The attaching portion can be made of rubber or other elastomeric material. However, the characteristics of the material forming the attaching portion, as well as the relative size and shape of the attaching portion and the handle are selected to tend to cause the pad to at least partly separate from the handle within a range of desired forces.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method of applying a treating agent to a surface utilizing an applicator comprising a pad and a handle that are friction fit together, the applicator and the handle having shapes that cooperate with each other to cause the applicator and the handle to be separable from one another when the friction forces between a working surface of the pad and the surface being treated become great enough to overcome the friction fit forces holding the pad to the handle, the method comprising the steps of:

(a) selecting a surface to be treated;

(b) applying a treating agent to at least one of the working surface of the pad or a portion of the surface to be treated;

(c) spreading the treating agent over the surface while exerting a downward force on the handle thereby producing a friction force between the pad and the surface; and (d) stopping the application of the agent to the surface to be treated when the pad is separated from the handle upon the friction forces between the working surface of the pad and the surface being treated overcoming the forces holding the pad to the handle.

2. The method of claim 1, wherein the pad is formed of an elastic foam material.

3. The method of claim 2, wherein the pad is formed of polyether.

4. The method of claim 1, wherein the treating agent is applied to a work surface of the pad prior to carrying out the step (c).

5. The method of claim 4, wherein the treating agent has a liquid component which dries up during application of the treating agent to the vehicle surface and wherein the pad is formed of an elastic material which separates from a pad engaging part of the handle during the step (c) as the treating agent dries.

6. The method of claim 1, wherein the treating agent is applied to the surface prior to carrying out the step (c).

7. The method of claim 6, wherein the pad is formed of polyether foam.

8. The method of claim 6, wherein the treating agent has a liquid component which dries up during application of the treating agent to the vehicle surface and wherein the pad is formed of an elastic material which separates from a pad engaging part of the handle during the step (c) when the treating agent dries.

9. The method of claim 8, wherein the pad is formed of polyether foam.

10. The method of claim 1, wherein the entire pad is formed of one or more foam materials.

11. The method of claim 1, wherein the working surface of the pad is formed of a foam material and the upper portion of the pad is formed of a rubber-like material.

12. The method of claim 1, further including the steps of reattaching the pad to the handle, providing a further quantity of treating agent to at least one of the working surface of the pad or a portion of the surface to be treated and then repeating the step (c).

13. The method of claim 1, further including the steps of reattaching the pad to the handle, providing a quantity of liquid to the treating agent located on at least one of the working surface of the pad or a portion of the surface to be treated and then repeating the step (c).

14. The method of claim 1, wherein the treating agent is a cleaning agent, a polishing agent and/or a waxing agent.

* * * * *